United States Patent [19]

Ikeda

[11] Patent Number: 4,762,349

[45] Date of Patent: Aug. 9, 1988

[54] LATCH FOR AN AUTOMOBILE DOOR

[75] Inventor: Ichio Ikeda, Aichi, Japan

[73] Assignee: Kabushikikaisha Anseikogyo, Aichi, Japan

[21] Appl. No.: 39,248

[22] Filed: Apr. 17, 1987

[30] Foreign Application Priority Data

Sep. 19, 1986 [JP] Japan ..... 61-221467

[51] Int. Cl.[4] ..... E05C 3/26

[52] U.S. Cl. ..... 292/216; 403/146; 292/DIG. 53; 292/227

[58] Field of Search ..... 292/216, 280, DIG. 53, 292/336.3, 347, 227; 403/146, 161, 162

[56] References Cited

U.S. PATENT DOCUMENTS

| | | | |
|---|---|---|---|
| 2,961,267 | 11/1960 | Hungerford | 292/280 |
| 3,591,216 | 7/1971 | Onufer | 403/146 |
| 3,905,627 | 9/1975 | Fujita | 292/216 |
| 4,018,104 | 4/1977 | Bland et al. | 403/146 X |
| 4,073,526 | 2/1978 | Sajfert | 292/347 |
| 4,135,694 | 1/1979 | Stegenga et al. | 403/146 X |
| 4,212,560 | 7/1980 | Pufpaff et al. | 403/146 X |
| 4,382,622 | 5/1983 | Ishikawa | 292/216 |
| 4,478,445 | 10/1984 | Shimizu | 292/336.3 |
| 4,492,395 | 1/1985 | Yamada | 292/216 |
| 4,508,379 | 4/1985 | Mochida | 292/216 X |

*Primary Examiner*—Richard E. Moore

*Attorney, Agent, or Firm*—Pollock, Vande Sande & Priddy

[57] ABSTRACT

A latch includes a latch body, an opening rod and a structure to connect the opening rod to the latch body. The latch body includes a latching member, a ratchet and an opening lever. The connection structure includes a shaft member connected, at the root portion thereof, to the opening lever and provided, at the free end thereof, with an elongate slip-out prevention member, an elongate rest mounted rotatably on the shaft member and a biased push plate mounted on the shaft portion for movement in the axial direction of the shaft portion. In assembling, one end portion of the opening rod is mated, at an elongate hole formed therein, with the elongate rest and slip-out prevention member. The opening rod is pushed towards the opening lever, turned by about 90° and returned away from the opening lever under the biasing force exerted on the push plate. The one end portion of the opening rod is caught by the rest without slipping out from the shaft portion and can operate the ratchet through the shaft portion.

4 Claims, 2 Drawing Sheets

LATCH FOR AN AUTOMOBILE DOOR

BACKGROUND OF THE INVENTION

1. Field of the Invention

This invention relates generally to a latch for maintaining the closed state of an automobile door. More particularly it relates to a structure for connecting an opening rod to an opening lever in such a latch.

2. Description of the Prior Art

A prior art latch for an automobile door as disclosed in the specification of U.S. Pat. No. 4,073,519 includes a latch body in which a latching member, a ratchet to hold the latching member and a release lever to release the hold of the latching member by the ratchet are mounted relative to a frame and a release rod for use in releasing the latch from outside the automobile. One end of the release rod is connected to the release lever through a pin. Namely the axial portion of the pin headed at one end thereof is inserted in a slot formed in the release lever and the extreme end of the axial portion is inserted in a hole formed in the release rod to be fixed therein by caulking.

The door latch of this type including the latch body with the attached long release rod becomes very bulky. When a number of door latches each carrying a lanky release rod are transported in a package, it is bulky as well. As a result, the transportation of latches is very expensive.

In order to lower the transportation cost of latches it may be possible to transport the latch together with the release rod which is not yet connected to the release lever of the latch body. It is possible, with the unconnected release rod, to pack up a number of latch bodies, each being of small bulk into one compact package. A number of release rods, each being lanky, can be bundled into another small package as well. Consequently the bulk of the above two packages is much smaller than the bulk of the package containing a number of completely assembled latches.

Each of the unconnected release rods, however, must be connected to the release lever of the latch body at the place to which they have been transported. The connecting work takes considerable time. The axial portion of the connection pin is first passed through the slot in the release lever and then the extreme end of the pin is inserted in the hole of release rod. Under this situation of connecting both component members are apt to be easily separated from each other. It is, therefore, necessary to caulk the inserted extreme end of the pin in the hole of the release rod. The latch body is heavy and the release rod is long, so these members are unwieldy and hard to connect. A special large-scale jig is required in order that the caulking work can be carried out with the latch body and the release rod supported stabily.

SUMMARY OF THE INVENTION

A first object of the present invention is to provide latches for an automobile door whose latch bodies and opening rods can be separately packed in large numbers and can be transported in a small bulk as a whole.

A second object of the present invention is to provide a latch for an automobile which can be easily assembled at the place to which separately packed latch bodies and opening rods have been transported.

According to the structure of the present invention, the assembling of a latch is finished by the work consisting mainly of inserting a pin provided in a latch body into an elongate hole formed in an opening rod. Therefore the work can be done very easily.

A third object of the present invention is to provide a latch for an automobile door including a connecting portion which can prevent the opening rod from slipping out from the latch body of the latch assembled only by the above mentioned simple work consisting mainly of the insertion of the pin.

DETAILED DESCRIPTION OF THE PREFERRED EMBODIMENTS

Figure 1:
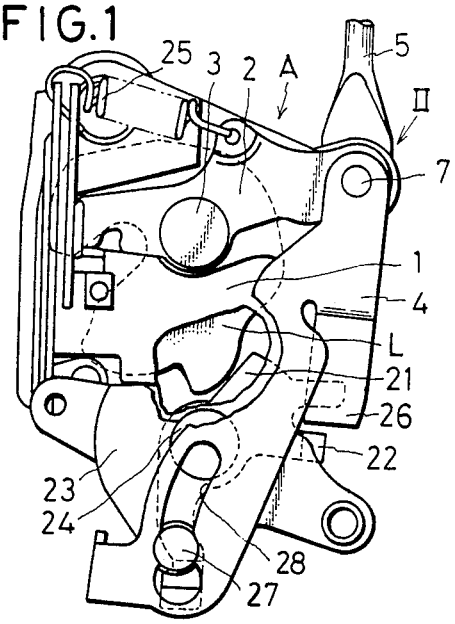
FIG. 1 is a front elevation of a latch for an automobile with a base frame shown in partial section.
Figure 4:
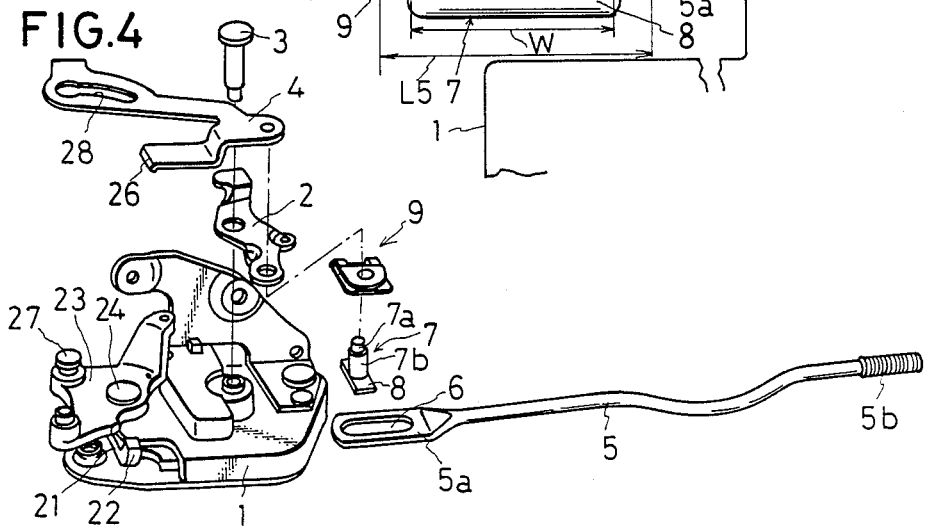
FIG. 4 is a perspective view of the latch in the dismantled state.

In the drawings, a latch for an automobile door includes a latch body A and an opening rod 5 connected to the latch body A. A base frame 1 in the latch body A is called a housing as well. As is well known, a latching member L adapted to engage a striker and a ratchet 21 to hold the latching member L are provided in the base frame 1. A metallic opening lever (called a release lever as well) 2 is pivotally mounted on the outside of the base frame 1 by a pin 3. A locking lever 23 is pivotally mounted on the outside of the base frame 1 by a pin 24. A metallic transmission lever 4 is connected to the end portion of the opening lever 2 by a pin 7 to be hereinafter described in detail. An urging portion 26 of the transmission lever 4 is opposed to an urged portion 22 of the ratchet 21 and can transmit the clockwise movement of the opening lever 2 in FIG. 1 to the ratchet 21. The opening lever 2 is biased in the counterclockwise direction in FIG. 1 by a return spring 25. A projecting piece 27 formed on the locking lever 23 is adapted in an elongate hole 28 formed in the transmission lever 4. As the locking lever 23 is turned the transmission lever 4 is shifted alternatively between an unlocked position, where the urging portion 26 and the urged portion 22 are opposed to each other, and a locked position, where they are not. The opening rod (also called a release rod) 5 is provided in order to transmit a force for releasing the ratchet to the opening lever 2. The rod 5 is metallic. As shown in FIG. 4, the rod 5 is provided, at one end thereof, with a connecting portion 5*a* for the opening lever 2 and, at the other end thereof, with a connecting portion 5*b* for a door handle. The former connecting portion 5*a* is formed with an elongate hole 6 for connection. Various opening rods different in form and length are prepared in accordance with types of automobiles where the latch is used. The aforementioned pin 7 is intended to connect the opening rod 5 to the opening lever 2. A constricted root portion 7*a* is fixed, by caulking, in a hole 4*a* formed in the transmission lever 4. A shaft portion 7*b* of the pin 7 is passed through a hole 2*a* of the opening lever 2 and extends beyond the lever 2. The pin 7 is formed, at the extreme end thereof, with a slip-out prevention member 8. This member 8 measures larger than the radius of the shaft portion 7*b* and extends beyond the side surface of the shaft portion 7*b*. The slip-out prevention member 8 is made in the form of a disk cut along a pair of parallel chords thereof to present an elongate form. The longitudinal dimension L1 of the slip-out prevention member 8 is set to a value which is smaller than the longitudinal dimension L3 but larger than the transverse dimension L4 of the elongate hole 6. The transverse dimension L2 of the member 8 is set to a value smaller than the transverse dimension L4 of the elongate hole 6.

Figure 3:
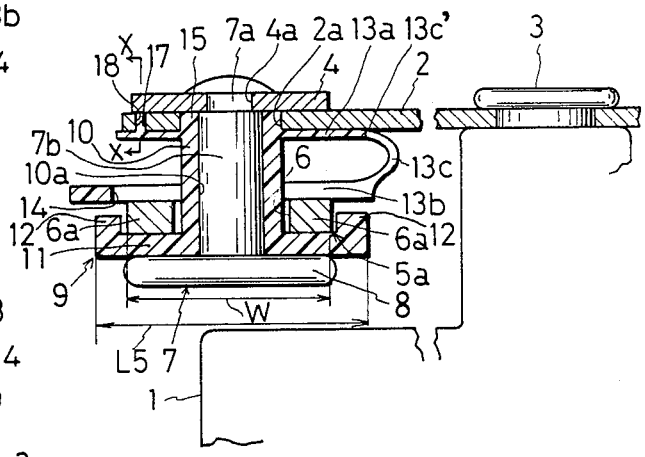
FIG. 3 is a section taken along line III—III in FIG. 2.
Figure 5:
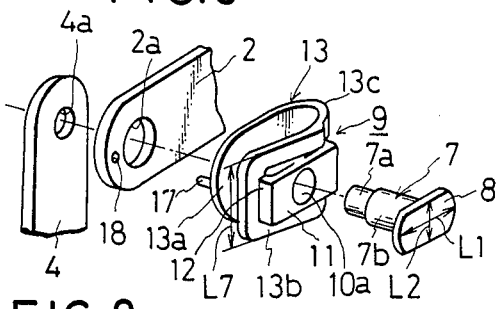
FIG. 5 is a perspective view showing the relationship among a transmission lever, the the opening lever, a washer and a pin all in the dismantled state.

A washer 9 adapted on the pin 7 is made of a resilient synthetic resin such as "6 nylon", polyacetal or the like. This washer 9 is made as an integral member in the form shown in FIG. 6. When the washer 9 is mounted on the pin 7, it is elastically deformed to the form as shown in FIG. 5. In the washer 9, a tubular washer body 10 is formed with an insertion hole 10*a*. The shaft portion 7*b* of the pin 7 is inserted in the insertion hole 10*a* and the washer 9 can rotate relative to the pin 7. The washer body 10 is prevented from slipping out by the slip-out prevention member 8. An elongate rest 11 is formed integrally with the washer body 10. The longitudinal dimension L5 of the rest 11 is smaller than the longitudinal dimension L3 and larger than the transverse dimension L4 of the elongate hole 6. The transverse dimension L6 of the rest 11 is set to a value smaller than the transverse dimension L4. Furthermore, the longitudinal dimension L5 of the rest 11 is made larger than the width W of the connecting portion 5*a* of the rod 5 as shown in FIG. 3. Both end portions of the rest 11 are formed with holding members 12, 12 extended towards the side of the opening lever 2. One end portion of the washer body 10 is formed with a biasing member 13. A base portion 13*a* of the biasing member 13 is connected to the washer body 10 and a push plate 13*b* at one end portion of the biasing member 13 is formed with a window 14 for insertion of the rest 11. An intermediate portion 13*c* of the biasing member 13 works as a leaf spring when it is elastically bent as shown in FIG. 3. The transverse dimension L7 (the dimension in the vertical direction in FIG. 5) of the push plate 13*b* is set to a value which is larger than either the transverse dimension L6 of the rest 11 or the transverse dimension L4 of the elongate hole 6. Furthermore, the longitudinal dimension of the push plate 13*b* is made longer than the longitudinal dimension of the rest 11. Namely, the push plate 13*b* is provided with integral extensions protruding beyond the rest 11 in the longitudinal and transverse directions of the rest 11. These extensions prevent the push plate 13*b* from passing through the elongate hole 6 of the opening rod 5 when the rest 11 is inserted in the elongate hole 6 of the rod 5. Alternately, the push plate 13*b* may be provided with the extension merely at longitudinal or transverse sides thereof. The other end portion of the washer body 10 is formed with a silencer tubular member 15. The outer diameter of this tubular member 15 is adjusted to a value suitable for close fitting in the hole 2*a* of the opening lever 2. A positioning projection 17 protruding from the base portion 13*a* of the biasing member 13 is made thin. For example, if the base portion 13*a* is 1.5 mm in thickness the projection 17 could be 0.8 mm in diameter. The opening lever 2 is formed with a positioning hole 18 at a location suitable to mate with the projection 17.

Figure 6:
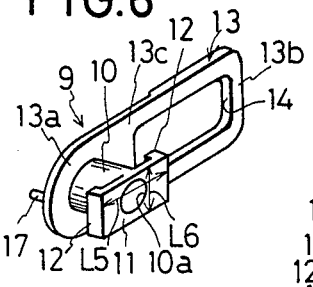
FIG. 6 is a perspective view showing the washer in shaping process.

The latch for an automobile door of the above mentioned structure is assembled as follows. First of all, the washer 9 in the form of FIG. 6 is prepared. The intermediate portion 13*c* of the biasing member 13 is then bent as shown in FIG. 5. The rest 11 is inserted in the window 14 and the edge portion of the push plate 13*b* is held by one of the holding members 12, 12.

Figure 8:
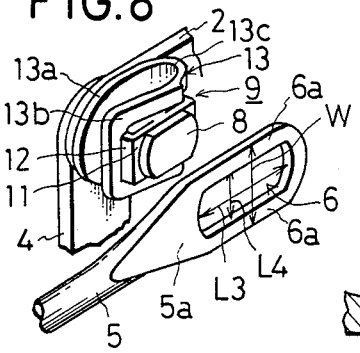
FIG. 8 is a perspective view showing the connection pin and the opening rod with one end thereof opposed to the pin.

The pin 7 is then mounted in order to connect the transmission lever 4 to the opening lever 2. In particular, in the arrangement as shown in FIG. 5, the pin 7 is passed through the insertion hole 10*a* of the washer 9 and further through the hole 2*a* in the opening lever 2 and is fixed, at the root portion 7*a* thereof, in the hole 4*a* of the transmission lever 4 by caulking. In this case, the longitudinal direction of the slip-out prevention member 8 is adjusted so that it coincides with a direction prescribed by design. In the present embodiment, the prescribed direction is one roughly perpendicular to the longitudinal direction of the transmission lever 4. When the completed latch is mounted on an automobile, this direction is roughly perpendicular to the direction of the movement of the rod 5 as well. The silencer tubular member 15 of the washer 9 is adapted in the hole 2*a* of the opening lever 2 and the positioning projection 17 is inserted in the hole 18. When the pin 7 has been mounted in this manner the longitudinal direction of the rest 11 is the same as the longitudinal direction of the slip-out prevention member 8 as shown in FIG. 8.

As is described above, the pin 7 is mounted when the opening lever 2 is not yet attached to the base frame 1. Accordingly, the mounting work is very easy.

Next, the opening lever 2 is attached by the pin 3 on the base frame 1 where the latching member L, the ratchet 21, the locking lever 23 and the other parts of the latch body have already been mounted. Before this lever 2 is attached, the projecting piece 27 of the locking lever 23 is adapted in the elongate hole 28 in the transmission lever 4. When the opening lever 2 is combined with the base frame 1 the opening lever 2 is appended on by the transmission lever 4 alone which is much smaller than the opening rod 5. Therefore, the opening lever 2 can easily be attached on the base frame 1. The mounting of various members on the base frame 1 is so far finished and the latch body A has been completed.

If so desired, the leaf spring, the intermediate portion 13*c* of the washer 9, may be bent after the opening lever 2 has been attached on the base frame 1, rather than beforehand, as described above.

Figure 7:
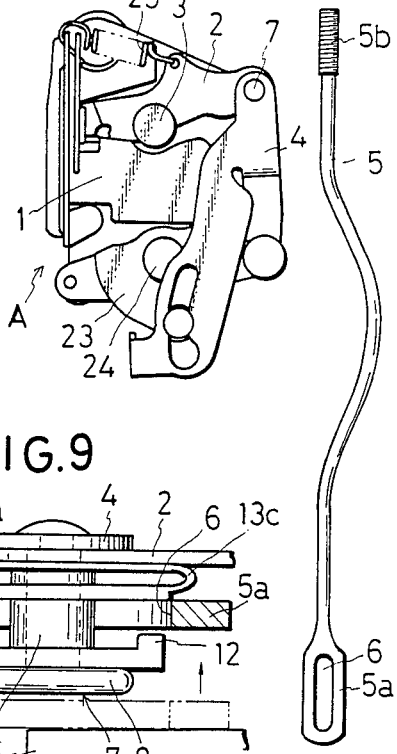
FIG. 7 is a front elevation of the latch in transportation wherein the opening rod is not yet connected to a latch body.

The latch body A completed in the above manner and the unmounted opening rod 5 are shown in FIG. 7.

The completed latch body A and the separate opening rod 5 can be transported. In this case, a number of completed latch bodies A can be packed into a single package. A number of opening rods 5 can be bundled similarly into a separate package.

Figure 2:
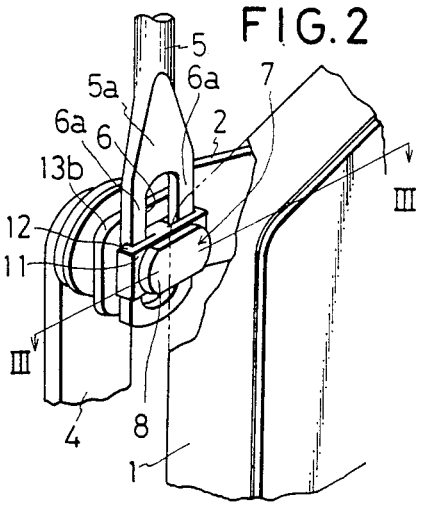
FIG. 2 is a perspective view seen from behind the latch of FIG. 1 in the direction of an arrow II, showing a connecting portion to connect an opening rod to an opening lever.
Figure 9:
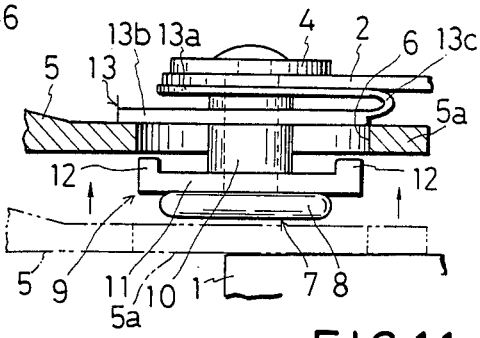
FIG. 9 is a view in partial section showing the process to connect the opening rod to the opening lever.

Now the opening rod 5 is connected to the opening lever 2 in the following manner. First the connecting portion 5*a* of the opening rod 5 is inserted between the base frame 1 and the slip-out prevention member 8 of the pin 7 as shown by lines of alternating one long and two short dashes in FIG. 9. The direction of the rod 5 is determined so that the longitudinal direction of the elongate hole 6 in the opening rod 5 coincides with the longitudinal directions of the slip-out prevention member 8 and the rest 11 as shown in FIG. 8. Then the opening rod 5 is displaced towards the opening lever 2 in the arrangement shown in FIG. 8 so that the slip-out prevention member 8 and the rest 11 can be set in the elongate hole 6. As shown in FIG. 9, the connecting portion 5*a* is pushed to urge the push plate 13*b* towards the opening lever 2 and is positioned closer to the opening lever 2 than the holding member 12. In this position, the opening rod 5 is then turned by about 90° relative to the opening lever 2 to make the the longitudinal direction of the elongate hole 6 coincide roughly with the transverse direction of the rest 11 as shown in FIG. 2. In this case, the positioning projection 17 adapted in the hole 18 prevents the washer 9 from turning relative to the opening lever 2. Accordingly, the the washer 9 is not turned together with the opening rod 5. Therefore, the longitudinal direction of the elongate hole 6 is made to coincide with the transverse direction of the rest 11 simply by turning the opening rod 5. Next, in the arrangement just established, the connecting portion 5*a* is released to remove the urging force exerted on the push plate 13*b*. Then the connecting portion 5*a* is returned towards the rest 11 by the push plate 13*b* under the biasing force of the leaf spring 13*c*. As the result, both side portions 6*a*, 6*a* of the elongate hole 6 are caught between the holding members 12, 12 as shown in FIGS. 2 and 3.

Figure 10A:
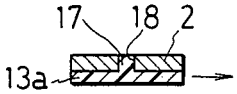
FIGS. 10(A) and (B) are sections taken along line X—X in FIG. 3, showing the process to cut a positioning projection.
Figure 10B:
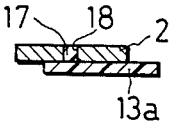

Next the opening rod 5 is turned by a large angle, either, to the right or to the left. The washer 9 is turned together with the opening rod 5, since the side portions 6*a*, 6*a* are caught between the holding members 12, 12 as mentioned above. Consequently, a shearing force is applied on the positioning projection 17 and in the manner as shown in FIGS. 10(A) and, (B), the projection 17 is cut off from the base portion 13*a* of the washer 9. The opening rod 5 is now mounted for activating the opening lever 2.

The connecting portion 5*b* of the opening rod 5, the connecting portion 5*a* of which has already been connected to the opening lever 2, is left a free end. Thus the opening rod 5 can be turned around the pin 7. However, the rest 11 moves together with the connecting portion 5*a* since the portion 5*a* is urged by the push plate 13*b* to be caught between the holding members 12. Consequently, the connecting portion 5*a* is prevented from moving beyond the slip-out prevention member 8 and slipping-out from the pin 7 even if the longitudinal direction of the elongate hole 6 in the connecting portion 5*a* coincides accidentally with the longitudinal direction of the slip-out prevention member 8.

The above-mentioned latch for an automobile operates in the following manner when mounted in an automobile. When the opening rod 5 is moved downwards in FIG. 1 by operating the door handle of the automobile, the opening lever 2 is turned in the clockwise direction in FIG. 1. The movement of the lever 2 is transmitted through the transmission lever 4 to the ratchet 21, which releases the latching member L. In this operation, any metallic sound due to the collision of metals is not uttered since the tubular member 15 made of a synthetic resin is interposed between the opening lever 2 and the pin 7, and the washer body 10 made of the same material is located between the opening rod 5 and the pin 7. Moreover, in the intermediate portion 13*c* of the washer 9, the end 13*c*′ close to the base portion 13*a* always urges the opening lever 2 against the transmission lever 4 as the reaction from the push plate 13*b* being urged against the connecting portion 5*a*. Accordingly, the trembling of the opening lever 2 due to the vibration of the automobile and therefore, the noise due to the trembling is prevented.

Moreover, in the above mounted state of the latch, the longitudinal direction of the elongate hole 6 is perpendicular to the longitudinal direction of the slip-out prevention member 8. Thus the connecting portion 5*a* is prevented from slipping out from the pin 7 even if the rest 11 is broken by some unexpected cause.

Next, the following operation is carried out when the opening rod 5 is removed from the pin 7 for such a purpose as to exchange the opening rod 5. The connecting portion 5*a* of the opening rod 5 is first pushed so that it is displaced towards the opening lever 2, as shown in FIG. 9. Then, in this arrangement, the opening rod 5 is turned by about 90° relative to the rest 11 and the slip-out prevention member 8 to make the longitudinal direction of the elongate hole 6 coincide with the longitudinal directions of the rest 11 and the slip-out prevention member 8. Then the connecting portion 5*a* is drawn from the pin 7 as shown by lines of alternating one long and two short dashes in FIG. 9. The opening rod 5 can thus be removed from the pin 7.

In the latch for an automobile according to the present embodiment, the opening rod 5, differing in form and length in accordance with the types of automobiles where the latch is mounted, is attached to the latch body at the last stage of the assembling process. Besides, the opening rod 5 can easily be attached to the latch body without requiring any tools. Accordingly, a latch maker has only to keep the single-type latch bodies A and the separate multi-type opening rods in stock. When an automobile maker places an order with the latch maker, the latter can attach an opening rod of the type meeting the order to a latch body and quickly deliver the completely assembled latches.

Figure 11:
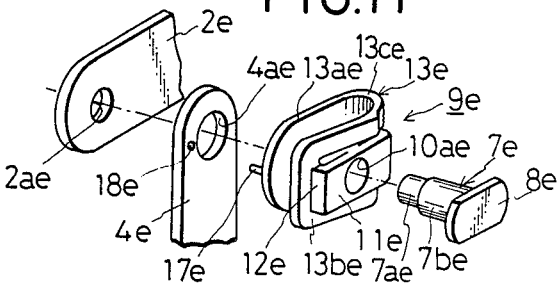
FIG. 11 is a perspective view of the dismantled state of another embodiment wherein the opening lever is differently positioned relative to a transmission lever.

Next, FIG. 11 shows a different embodiment in which the positional relationship between an opening lever 2*e* and a transmission lever 4*e* is the reverse of the previous embodiment. In this embodiment a pin 7*e* is caulked in an hole 2*ae* in the opening lever 2*e* and a transmission lever 4*e* is mounted, at a hole 4*ae* thereof, on the pin 7*e*. In FIG. 11, members which can be considered the same as or equivalent to those of the previous embodiment are given numerals which are the same as those given to the corresponding members in the previous embodiment but are followed by the letters. The explanations of these members are not repeated. In the figures following FIG. 11, the letter f or g is affixed to refer to numerals corresponding to the same functions in the first embodiment and the explanation is not repeated.

Figure 12:
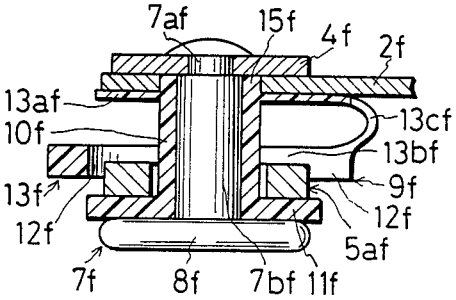
FIG. 12 is a section of another washer different in form.

FIG. 12 shows a still different embodiment having a washer 9*f* in which a holding member 12*f* is formed integrally with a push plate 13*bf* of a biasing member 13*f*. In the present embodiment the turning motion of a connecting portion 5*af* around a pin 7*f* is transmitted to a rest 11*f* through the biasing member 13*f* and a washer body 10*f*. Accordingly the rest 11*f* is turned together with the connecting portion 5*af*.

Figure 13:
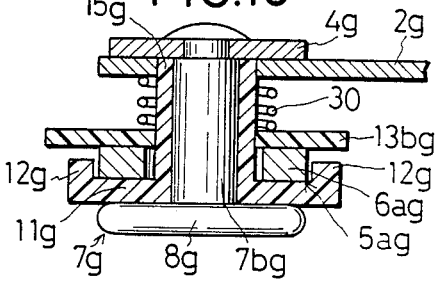
FIG. 13 is a section of a different biasing means.

FIG. 13 shows a still different embodiment in which a compression coil spring 30 is interposed as a biasing means between an opening lever 2*g* and a push plate 13*bg*.

What is claimed is:

1. A latch for an automobile door including:

(a) a latch body including a latching member, a ratchet for holding said latching member, and an opening lever for releasing the hold of said latching member by said ratchet, said latching member, ratchet and opening lever mounted relative to a base frame;

(b) an opening rod having one end connected with said opening lever and another end connected with a door handle of said automobile; and (c) a connection means for connecting said opening lever to said one end of said opening rod comprising:

a pin, said pin including a shaft portion, a root portion at one end of said shaft portion and a slip-out prevention member at the other end of said shaft portion, said shaft portion being connected, at the root portion thereof, to said opening lever;

an elongate rest mounted rotatably on said shaft portion between said opening lever and said slip-out prevention member;

a push plate mounted for movement in the axial direction of said shaft portion between said opening lever and said elongate rest and biased towards said elongate rest;

an elongate hole formed in said one end of said opening rod for insertion of said shaft portion, the longitudinal and transverse dimensions of said elongate hole being larger than the longitudinal and transverse dimensions of said elongate rest, respectively, and the transverse dimension of said elongate hole being smaller than the longitudinal dimension of said elongate rest; and an extension protruding from said push plate beyond the periphery of said elongate rest in the direction perpendicular to the axis of said shaft portion and preventing said push plate from passing through said elongate hole in said opening rod when said elongate rest is inserted in said elongate hole.

2. A latch for an automobile door as set forth in claim 1 wherein said slip-out prevention member extends from both sides of the free end of said shaft portion and the longitudinal dimension of said slip-out prevention member is larger than the transverse dimension and smaller than the longitudinal dimension of said elongate hole.

3. A latch for an automobile door as set forth in claim 2 wherein a tubular washer body is rotatably mounted on said shaft portion, said elongate rest is formed on said one end of said washer body, a leaf spring is connected, at one end thereof, to the other end of said washer body, the other end of said leaf spring is connected to said push plate, and said washer body, said elongate rest, said push plate and said leaf spring are made of a synthetic resin integrally with one another.

4. A latch for an automobile as set forth in claim 3, wherein a transmission lever for transmitting the motion of said opening lever to said ratchet of said latch is arranged along the side of said opening lever opposite to the side of said shaft portion, the root portion of said shaft portion being passed through a hole formed in said opening lever and secured in said transmission lever, a tubular member formed integral with said other end of said washer body is interposed between the wall of said hole formed in said opening lever and said shaft portion inserted in said hole and one end of said leaf spring being adapted to bias said opening lever towards said transmission lever.

* * * * *